US006095389A

United States Patent [19]

Fenton et al.

[11] Patent Number: 6,095,389

[45] **Date of Patent: *Aug. 1, 2000**

[54] BACKPACK

[75] Inventors: Timm Fenton, Lebanon, N.J.; Paul Scicluna, Penndel, Pa.

[73] Assignee: Tumi, Inc., South Plainfield, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/166,629

[22] Filed: Oct. 5, 1998

[51] Int. Cl.[7] ..... A45F 3/04

[52] U.S. Cl. ..... 224/627; 224/259; 224/600; 224/628

[58] Field of Search ..... 224/627, 600, 224/628, 639, 257, 259, 265, 272, 178, 607, 158, 159, 160, 606, 264, 901; 190/115

[56] References Cited

U.S. PATENT DOCUMENTS

| | | | |
|---|---|---|---|
| 125,188 | 4/1872 | Foy | 224/627 |
| 268,932 | 12/1882 | Poirier | 224/639 |
| 3,259,285 | 7/1966 | Bush | 224/600 |
| 3,802,613 | 4/1974 | Droeger | 224/627 |
| 4,420,103 | 12/1983 | Douglass | 224/630 |
| 4,550,869 | 11/1985 | Johnson | 224/607 |
| 5,361,955 | 11/1994 | Gregory | 224/211 |

*Primary Examiner*—Gregory M Vidovich
*Assistant Examiner*—Maerema W. Brevard
*Attorney, Agent, or Firm*—Baker Botts, L.L.P.

[57] ABSTRACT

A backpack includes a body defining a receptacle and having a back wall with an upper edge and a pair of spaced-apart shoulder straps having upper ends attached to the body proximate to the upper edge of the back wall of the body. A carrying handle is connected to the shoulder straps in spaced-apart relation to the upper ends of the shoulder straps and defines with the back wall of the body an opening that is adapted to accept the fingers of a user when the user grasps the carrying handle. The carrying handle includes a handle cover that is adapted to maintain portions of the shoulder straps to which the carrying handle is attached in spaced-apart relation when the handle is in use so that the carrying handle is comfortable to hold and does not pinch the user's hand.

12 Claims, 3 Drawing Sheets

BACKPACK

BACKGROUND OF THE INVENTION

Backpacks have for some time been very popular with children and young adults for carrying books and other articles to school or recreational activities. Recently, it has been increasingly common for older adults to use backpacks in place of large handbags or briefcases. The user of a backpack often has occasion to carry a backpack by hand. Accordingly, most backpacks have a carrying handle, which is usually a length of webbing that is attached at its ends to the upper end of the back of the backpack body and forms a loop that is large enough to be grasped. A handle in the form of a webbing loop tends to pinch the sides of the user's hand and can quickly become uncomfortable. Frequently, the user finds it more comfortable to use one of the shoulder straps as a carrying handle. Using a shoulder strap as a carrying handle allows the backpack body to hang down low to the ground, sometimes far enough down so that the shoulder strap that is not being grasped or even the body of the backpack touches the ground.

Another aspect of the construction of a backpack is the manner by which the straps are supported comfortably on the tops of the user's shoulders. Care must be taken in the design of the backpack to have the portions of the shoulder straps that rest on the shoulders stay in place and not slip off to the sides. At the same time, the straps should not tend to pull toward each other at the back of the user's neck. The positions of the portions of the shoulder straps that rest on the tops of the user's shoulders is largely governed by the spacing between the upper ends of the straps where they are attached to the body of the backpack. For any given spacing of the upper ends of the shoulder straps, the positions of the portions of the straps that rest on the user's shoulders varies somewhat, depending on the height at which the body of the backpack is carried on the user's back. If the body is carried high up on the user's back, the shoulder straps tend to pinch the back of the user's neck. If the body is carried low on the user's back, the shoulder straps can slip off to the laterally outer sides of the shoulders and may be uncomfortable to the user.

SUMMARY OF THE INVENTION

An object of the present invention is to provide a backpack with a carrying handle that is comfortable to grasp. It is also an object to facilitate carrying a backpack by hand with all parts clear of the ground when the backpack is carried by hand with the user's arm fully extended. Yet another object is to impart increased geometric stability to the portions of the shoulder straps that overlie the user's shoulders when the backpack is carried on the user's back.

The foregoing objects are attained, in accordance with the present invention, by a backpack that has a body defining a receptacle and having a back wall with an upper edge and a pair of spaced-apart shoulder straps having upper ends attached to the body proximate to the upper edge of the back wall of the body. A carrying handle is connected to the shoulder straps in spaced-apart relation to the upper ends of the shoulder straps and defines with the back wall of the body an opening that is adapted to accept the fingers of a user when the user grasps the carrying handle.

The carrying handle can have various configurations. In one form, the carrying handle is a piece of a textile material, such as a webbing. It is highly advantageous, and preferred, for the carrying handle to either be or include a member of a semi-rigid material adapted to maintain portions of the shoulder straps to which the carrying handle is attached in spaced-apart relation when the handle is in use. A semi-rigid member keeps that handle from pinching the sides of the user's hand and also stabilizes portions of the shoulder straps that lie below the back of the user's neck when the backpack is carried on the user's back. Thus, an embodiment of the present invention may have a carrying handle that has a webbing or other fabric strip that joins the shoulder straps and a handle cover that imparts a degree of rigidity to the carrying handle. A suitable handle cover may also have padding such as a sheet of soft polymeric foam for enhanced comfort. The foam sheet may wrap around the textile band and be covered by a wrapper sheet, which may be a textile sheet or a sheet of soft solid polymeric material. A wrapper sheet of leather is possible. A leather sheet wrapped around a textile band, with or without padding between the leather sheet and the band, provides a very desirable carrying handle.

The shoulder straps may have tabs that are unitary with and extend laterally from the shoulder straps and toward each other, the tabs serving as attachment portions for the handle and also forming part of the handle. In an exemplary embodiment, each shoulder strap is a sandwich of inner and outer sheets of textile material on opposite faces of a flexible polymeric material, such as a flexible foam. The handle is a sandwich of the tabs, which preferably abut each other end to end at the center of the handle, inner and outer webbing strips sandwiching the tabs between them and joining the tabs, and a handle cover.

A backpack according to the present invention is comfortable to grasp, facilitates carrying a backpack by hand with all parts clear of the ground when the backpack is carried with the user's arm fully extended, and imparts increased geometric stability to the portions of the shoulder straps that overlie the user's shoulders when the backpack is carried on the user's back.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENT

Figure 1:
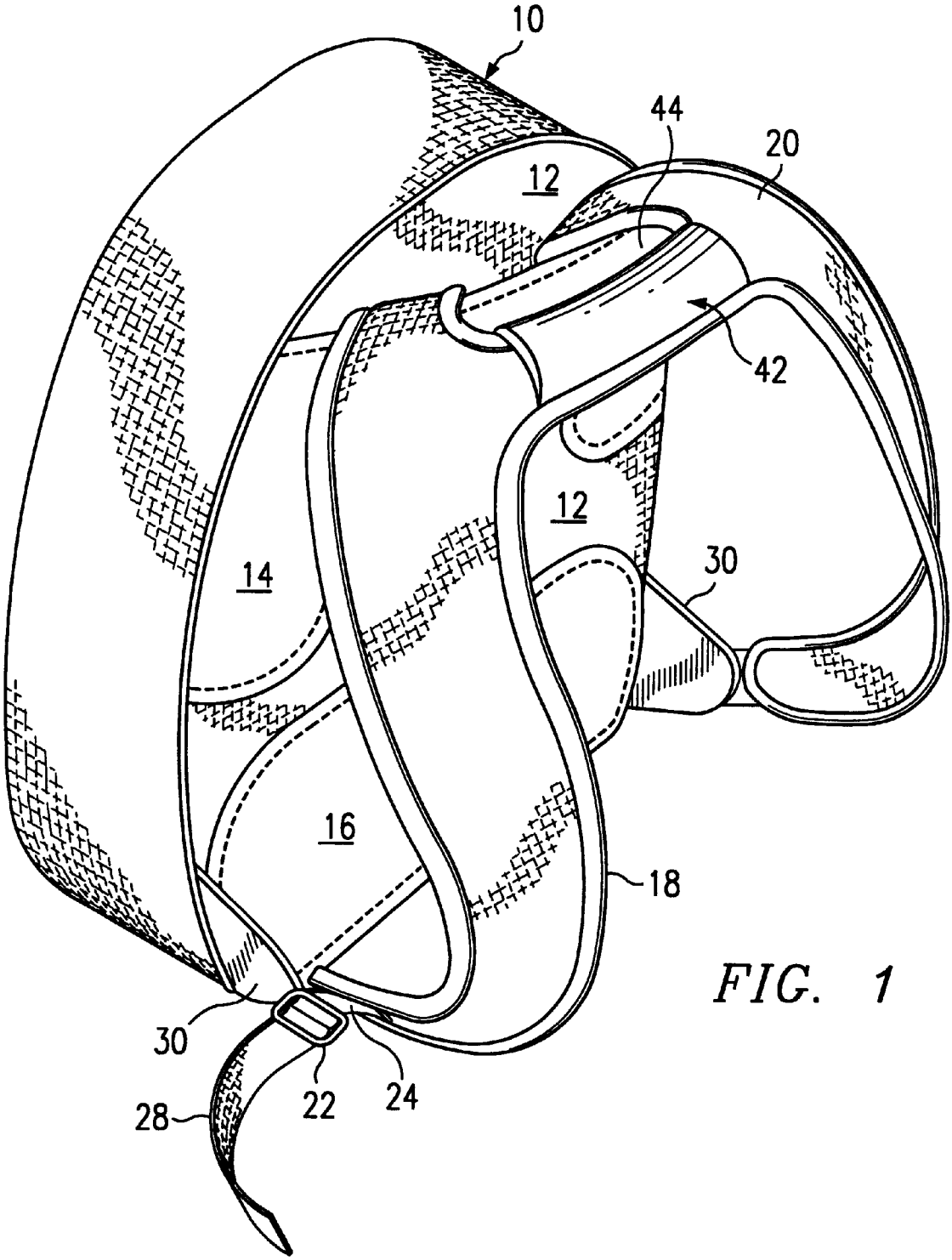
FIG. 1 is a three-quarter rear elevational view from a view point slightly above of a first embodiment.
Figure 2:
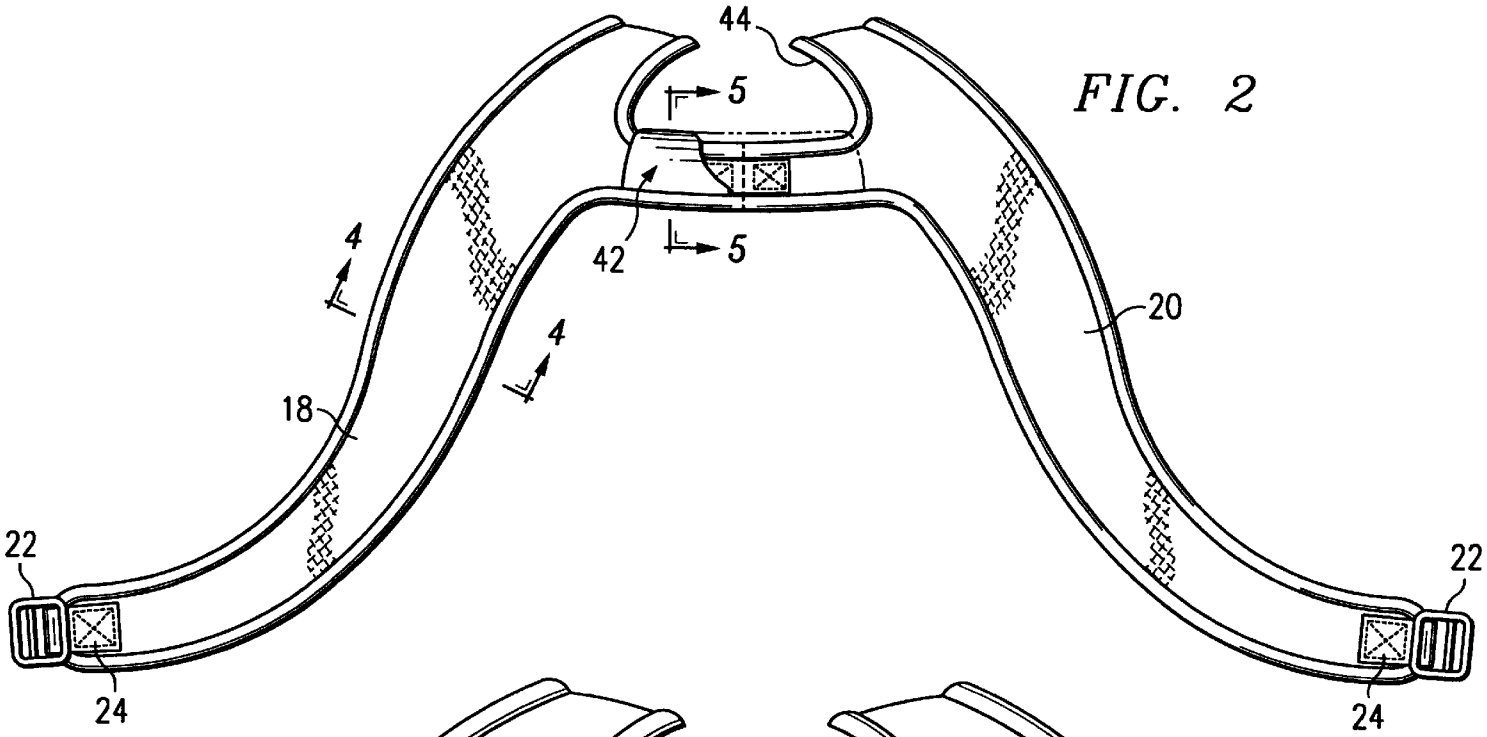
FIG. 2 is a plan view of the shoulder straps and carrying handle of the first embodiment, shown in flattened condition.

The backpack shown in FIG. 1 has a body 10 made of panels of a durable fabric joined by stitching and forming a receptacle for containing articles of all sorts. The body 10 may be of any desired shape and construction and can include various pockets on the front and side walls and other features that are known per se. The embodiment has a back wall 12, which has an inverted generally U-shaped upper pad 14 and a roughly rectangular lower pad 16. The pads 14 and 16 are optional.

The upper end of each of a pair of shoulder straps 18 and 20, each of which is the mirror image of the other, is attached to the back wall 12 of the body 10 a short distance below the upper edge. It is, of course, possible for the shoulder straps to be attached at the juncture of the upper edge of the back wall with the top wall of the body. Each strap diverges with respect to the other from the upper attachment point, curves back toward the other strap in a region that overlies the user's shoulders and then curves away from the other strap to a lower end, to which an adjustable buckle 22 is fastened by a webbing loop 24. Each buckle receives the upper end of a webbing 28, the lower end of which is fastened to a tab 30 extending from the lower portion of the side of the back wall 12 of the body 10.

Figure 4:
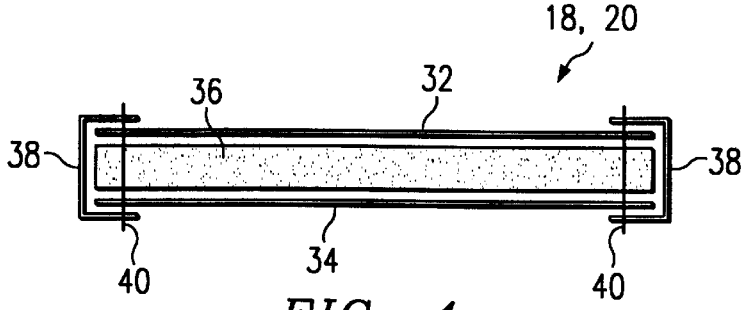
FIG. 4 is a cross-sectional view of a shoulder strap taken along the lines 4—4 of FIG. 2 and is typical of all cross-sections.

Each strap 18 and 20 is a sandwich (see FIG. 4) of an outer fabric 32, which may be the same fabric that is used for the body 10, an inner fabric 34, which may be an open mesh net fabric, and a flexible polymeric foam sheet 36, such as a PVC foam, which is sandwiched between the fabrics 32 and 34. The edges of the fabric-foam-fabric sandwich of each shoulder strap 18, 20 are bound along their entire extents by binding tapes 38 and stitching 40.

A carrying handle 42 is formed by a composite structure that connects the shoulder straps 18 and 20 to each other a short distance from the upper ends, the distance being sufficient to leave an opening 44 (see FIG. 1) between the upper edge of the back wall 12 of the body 10 and the handle 42 to accept the fingers of a user when he or she grasps the handle 42 to carry the backpack. The length of handle is sufficient to accept the user's hand with room to spare so that the hand is not pinched by the shoulder straps when the backback is carried by the handle. As mentioned above, the handle may be of various constructions.

Figure 3:
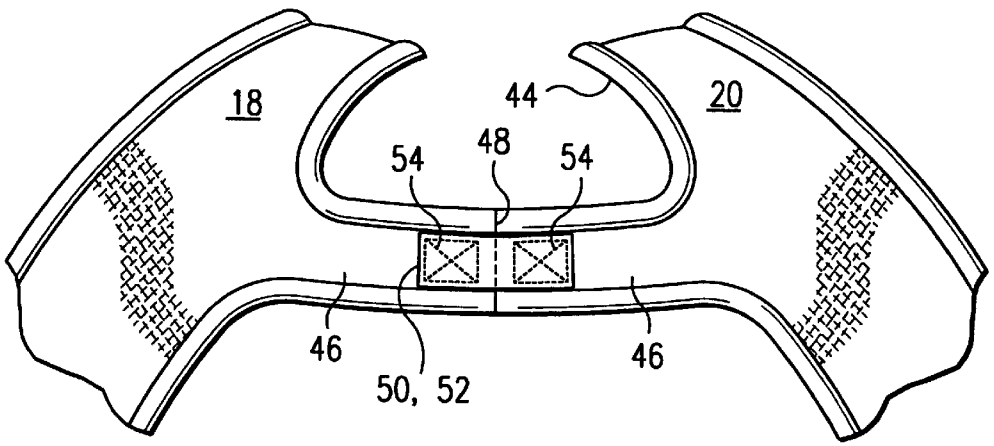
FIG. 3 is a partial detail plan view of the shoulder straps and carrying handle of the first embodiment, shown in flattened condition and with the handle cover removed.

In the first embodiment (FIGS. 1 to 5), the handle 42 is formed by tabs 46 (see FIG. 3) that are unitary with the straps 18, 20, extend toward each other and meet at a butt joint 48, and are connected by webbing strips 50 and 52—there is a webbing strip on each face of the abutting tabs (see FIG. 5) in order to impart high strength to the handle. The tabs and webbing strips are joined by stitching 54.

A handle cover 56 encases the tabs and webbing strips. The handle cover can be of various constructions and materials, such as a band of leather wrapped around the tabs and webbing strips and having its edges stitched to each other and to the edges of the tabs 46 opposite from the opening 44 so that the leather cover presents a smooth surface to the user's hand. Another form of suitable handle cover is a moldment of a semi-rigid, polymeric material, which can be molded flat and have a living hinge line that allows it to fold over the handle base—i.e., the tabs and webbing strips—and to be joined into a tube by thermal welding, an adhesive, stitching, or mechanical fasteners. The handle cover can also be of a solid, flexible polymeric sheet material and constructed in a manner similar to the wrap-around leather cover described above. A moldment formed in situ over a handle base is also possible.

In the first embodiment (FIGS. 1 to 5), the handle cover 56 consists of a sheet of a flexible polymeric foam 58 that is covered by a wrapper sheet 60, which may be a fabric or a solid flexible polymeric film, such as PVC. Portions along the edges of the wrapper sheet 60 are turned under the foam sheet 58 so that when the cover is installed on the handle base, the folded-under portions finish the edges of the cover and conceal and protect all edges of the foam sheet 58. The cover is installed after the tabs 46 are joined by the webbing strips 50 and 52 and the binder tape portion 38*a* has been secured by stitching 62 along the edge of the opening 44 (see FIG. 5). The cover wraps over the handle base and is fastened by a binding tape portion 38*b* and stitching 64.

Figure 5:
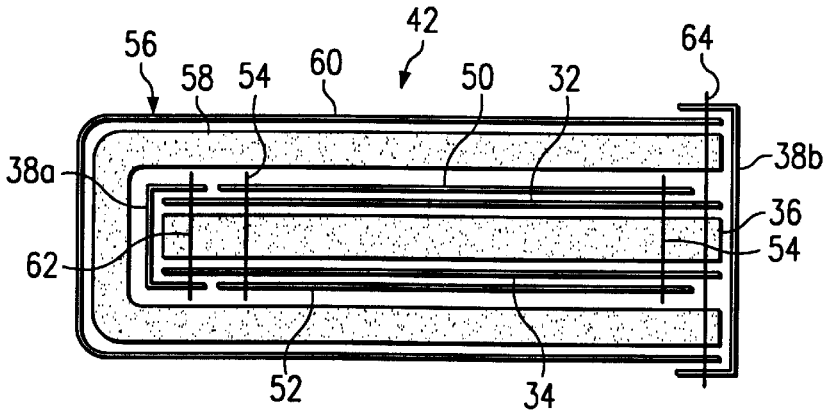
FIG. 5 is a cross-sectional view of the handle of the first embodiment, taken along the lines 5—5 of FIG. 2.

FIG. 5 shows the handle 42 diagrammatically for clarity—in practice, the various stitches through foam compress the foam along the stitch lines. On the other hand, the handle 42 is relatively thick, due to the presence of three layers of foam. The foam and the sandwich construction make the handle relatively stiff so that it retains its shape and length when grasped, but it is also soft and comfortable when grasped. When the backpack is carried on a user's back, the carrying handle 42 lies along the user's back below the base of the neck and between the adjacent portions of the shoulder straps. Its presence is hardly noticed and causes no discomfort. The handle also helps stabilize the positions of the shoulder straps where they turn upwardly and forwardly over the tops of the user's shoulders.

Figure 6:
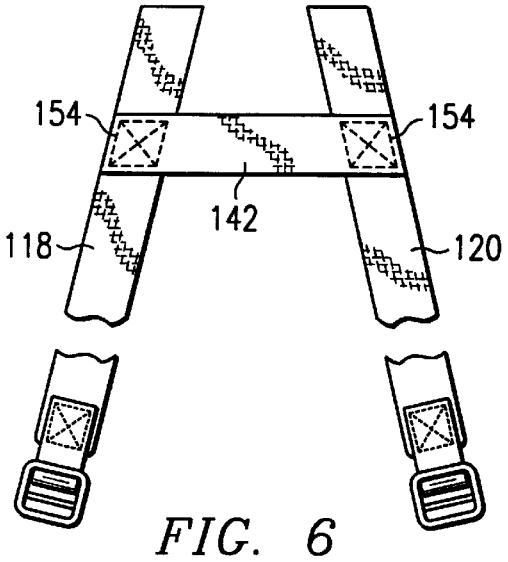
FIG. 6 is a plan view of the shoulder straps and carrying handle of a second embodiment.

FIG. 6 shows a very simple form of the invention, in which the shoulder straps 118 and 120 are webbing (which may or may not have padding) and the carrying handle 142 is a length of textile, such as webbing, or plastic sheet in each case one or more layers, which may be of different materials, may be plied together—the ends of which are stitched or otherwise suitably joined, such as by stitching 154, to the shoulder straps.

Figure 7:
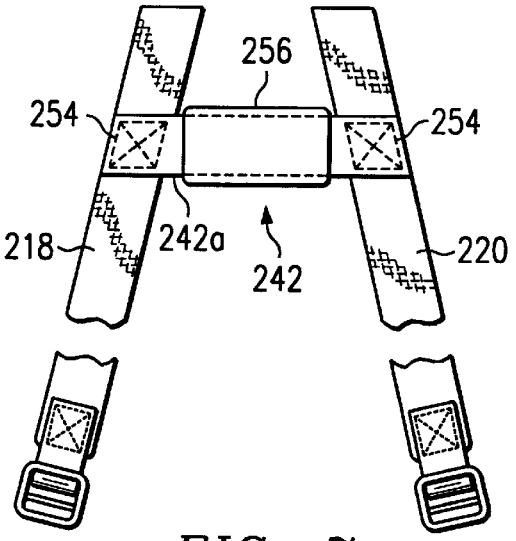
FIG. 7 is a plan view of the shoulder straps and carrying handle of a third embodiment.

In the third embodiment (FIG. 7) the shoulder straps 218 and 220 are of webbing (again, with or without padding) and the carrying handle 242 consists of a handle base 242*a* of webbing suitably joined, such as by stitching 254, to the shoulder straps and a handle cover 256 over the handle base. The handle cover may be of any of the forms mentioned above.

What is claimed is:

1. A backpack comprising a body defining a receptacle and having a back wall with an upper edge;

a pair of spaced-apart shoulder straps having upper ends attached to the body proximate to the upper edge of the back wall of the body; and a carrying handle extending between and having ends immovably affixed to the shoulder straps in closely spaced-apart relation to the upper ends of the shoulder straps and defining with the back wall of the body an opening adapted to accept the fingers of a user, the carrying handle including a band of textile material joined to portions of the shoulder straps and a handle cover of a semi-rigid material surrounding the band of textile material and adapted to maintain portions of the shoulder straps to which the carrying handle is attached in spaced-apart relation when the handle is in use.

2. The backpack according to claim 1 wherein the handle cover includes a flexible polymeric foam sheet that wraps around the band of textile material.

3. The backpack according to claim 2 wherein the handle cover includes a wrapper sheet covering the flexible polymeric foam sheet.

4. The backpack according to claim 1 wherein the portions of the shoulder straps to which the band is attached are tabs that are unitary with and extend laterally from the shoulder straps and toward each other.

5. The backpack according to claim 1 wherein the handle cover includes a flexible polymeric foam sheet that wraps around the band of fabric and a wrapper sheet of flexible material covering the flexible polymeric foam sheet.

6. The backpack according to claim 5 wherein the wrapper sheet is of a polymeric material.

7. The backpack according to claim 5 wherein the wrapper sheet has edge portions that turn under the foam sheet and lie between the foam sheet and the band of textile material.

8. A backpack comprising a body defining a receptacle and having a back wall with an upper edge;

a pair of spaced-apart shoulder straps having upper ends attached to the body proximate to the upper edge of the back wall of the body, each shoulder strap being a sandwich of inner and outer textile materials on opposite faces of a flexible polymeric material; and a carrying handle extending between and having ends immovably affixed to the shoulder straps in closely spaced-apart relation to the upper ends of the shoulder straps and defining with the back wall of the body an opening adapted to accept the fingers of a user, the carrying handle including tabs that are unitary with and extend laterally from the shoulder straps and toward each other a webbing strip fastened to the tabs so as to connect them to each other, and a handle cover of a semi-rigid material surrounding the tabs and webbing strip and adapted to maintain, portions of the shoulder straps to which the carrying handle is attached in spaced-apart relation when the handle is in use.

9. The backpack according to claim 8 wherein the handle cover includes a flexible polymeric foam sheet that wraps around the tabs and webbing strip.

10. The backpack according to claim 9 wherein the handle cover includes a wrapper sheet of flexible material covering the flexible polymeric foam sheet.

11. The backpack according to claim 10 wherein the wrapper sheet is of a polymeric material.

12. The backpack according to claim 10 wherein the wrapper sheet has edge portions that turn under the foam sheet and lie between the foam sheet and the band of textile material.

* * * * *